US006499195B1

(12) United States Patent
Wong

(10) Patent No.: US 6,499,195 B1
(45) Date of Patent: Dec. 31, 2002

(54) HAIR CURLER HEATING APPLIANCE

(75) Inventor: Ying Man John Wong, Shatin (CN)

(73) Assignee: Raymond Electric (China) Ltd., Shatin (CN)

( * ) Notice: Subject to any disclaimer, the term of this patent is extended or adjusted under 35 U.S.C. 154(b) by 0 days.

(21) Appl. No.: 09/951,539

(22) Filed: Sep. 13, 2001

(51) Int. Cl.[7] ..... A45D 4/12
(52) U.S. Cl. ..... 21/222
(58) Field of Search ..... 219/222, 466, 219/465, 467, 483, 242; 392/405, 394

(56) References Cited

U.S. PATENT DOCUMENTS 3,610,878 A * 10/1971 Thomas et al. ..... 132/229
4,110,600 A * 8/1978 Spotts et al. ..... 126/110 AA
4,984,591 A * 1/1991 Jacobi ..... 132/226
5,117,090 A * 5/1992 Askins ..... 132/229
5,981,908 A * 11/1999 McGuire et al. ..... 132/229

* cited by examiner

*Primary Examiner*—Teresa Walberg
*Assistant Examiner*—Vinod D. Patel
(74) *Attorney, Agent, or Firm*—Alix, Yale & Ristas, LLP

(57) ABSTRACT

A hair curler heating appliance incorporates a plurality of heating posts over which curlers are placed. Individual heaters are vertically arranged within each heating post. Curlers are configured with a metal interior defining a thermal interface with the heater posts. Heat is efficiently transferred outwardly from the heaters through the heater post to the metal interior of each hair curler. No part of the heater is exposed to dissipate heat so that substantially all heat generated by each heater is transferred to each corresponding hair curler.

12 Claims, 5 Drawing Sheets

HAIR CURLER HEATING APPLIANCE

BACKGROUND OF THE INVENTION

1. Field of the Invention

This invention relates generally to personal care devices for grooming hair and more particularly to hair curlers and devices for heating hair curlers.

2. Description of the Related Art

Hair setting and curling devices are well known that include means for heating hair rollers to a selected temperature for use in the curling or setting of hair. These devices usually comprise a casing that has supports for detachably holding and heating hair rollers. When the rollers are heated to a desired temperature they are removed from the supports. The user winds a cluster of hair around the outer surface of the heated roller and as a result the hair is more readily curled. The roller may be removed from the hair after several minutes.

An example of a hair roller as described above is shown in U.S. Pat. No. 3,600,552 issued to Tolmie for portable electric appliance. The Tolmie Patent discloses a hair setting and curling means including hair roller means and heating apparatus therefore. The heating apparatus is provided in a casing that includes a heating plate having a plurality of spaced and parallel rail members. Hair rollers are provided that have grooves in one end adapted to be fitted over the rails, thereby enabling heat to be conducted from the rail members to the rollers.

Another example of a hair roller heating appliance as described above is shown in U.S. Pat. No. 6,114,661 issued to Anthony Leung for a hair curler with slot adapted to receive a rail-like heat conductor. The Leung Patent discloses hair rollers assembled from a pair of semi-cylindrical members where each hair roller is configured to fit over a rail-like heating apparatus. An electrical heater in the shape of a bar is arranged to receive a plurality of hair rollers for heating thereon.

The Tolmie device is inefficient because heat must be transferred from the heater element to the heater case and then from the heater case to the heater rails holding the hair curlers. Heat is lost at each heat transfer interface. The Leung device improves upon the Tolmie device by forming the heating element into a rail-like configuration over which the hair rollers are placed. In the Leung configuration heat is transferred directly from the heating element to the hair curlers. However, the Leung device has the disadvantage of including a cross-wise slot through each hair roller. The heating element passes through the slot, thereby exposing any plastic portions on the exterior of the hair roller to high temperatures. These high temperatures can damage or melt the plastic, limiting the materials available for the exterior of the hair roller. Further, the transverse slot through each roller potentially entangles hair wound around the roller. More importantly, heat energy generated by the heating element is lost to the air where the heating element extends between hair curlers disposed thereon.

Accordingly, a need exists for a more effective heating arrangement in which the path of heat conduction to a hair roller is as short as possible, minimum heat energy is lost and in which the hair roller is of a cylindrical configuration.

SUMMARY OF THE INVENTION

An object of the invention is to provide a new and improved hair curler-heating appliance which quickly and efficiently heats hair curlers.

Another object of the present invention is to provide a new and improved hair curler heating appliance which receives and supports hair curlers of cylindrical configuration.

A still further object of the present invention is to provide a new and improved hair curler heating appliance of energy efficient design.

These and other objects of the invention are achieved by a hair curler heating appliance in which each of a plurality of resistive heaters is disposed in a heater tube which is in turn received in an axial cavity of a hair curler. This arrangement generates heat precisely where it is needed and leaves no part of each heater exposed to dissipate heat. Thus, minimum electrical energy is required to heat a plurality of hair curlers to a desired temperature.

A base plate supports multiple heater tubes in a compact, staggered arrangement. A thermostat is arranged to sense the temperature of the base plate and disconnect electrical energy from the base plate when a pre-determined temperature is reached. The relationship of base plate temperature to heater tube temperature is known, permitting the thermostat to be calibrated.

DETAILED DESCRIPTION OF THE PREFERRED EMBODIMENT

Figure 1:
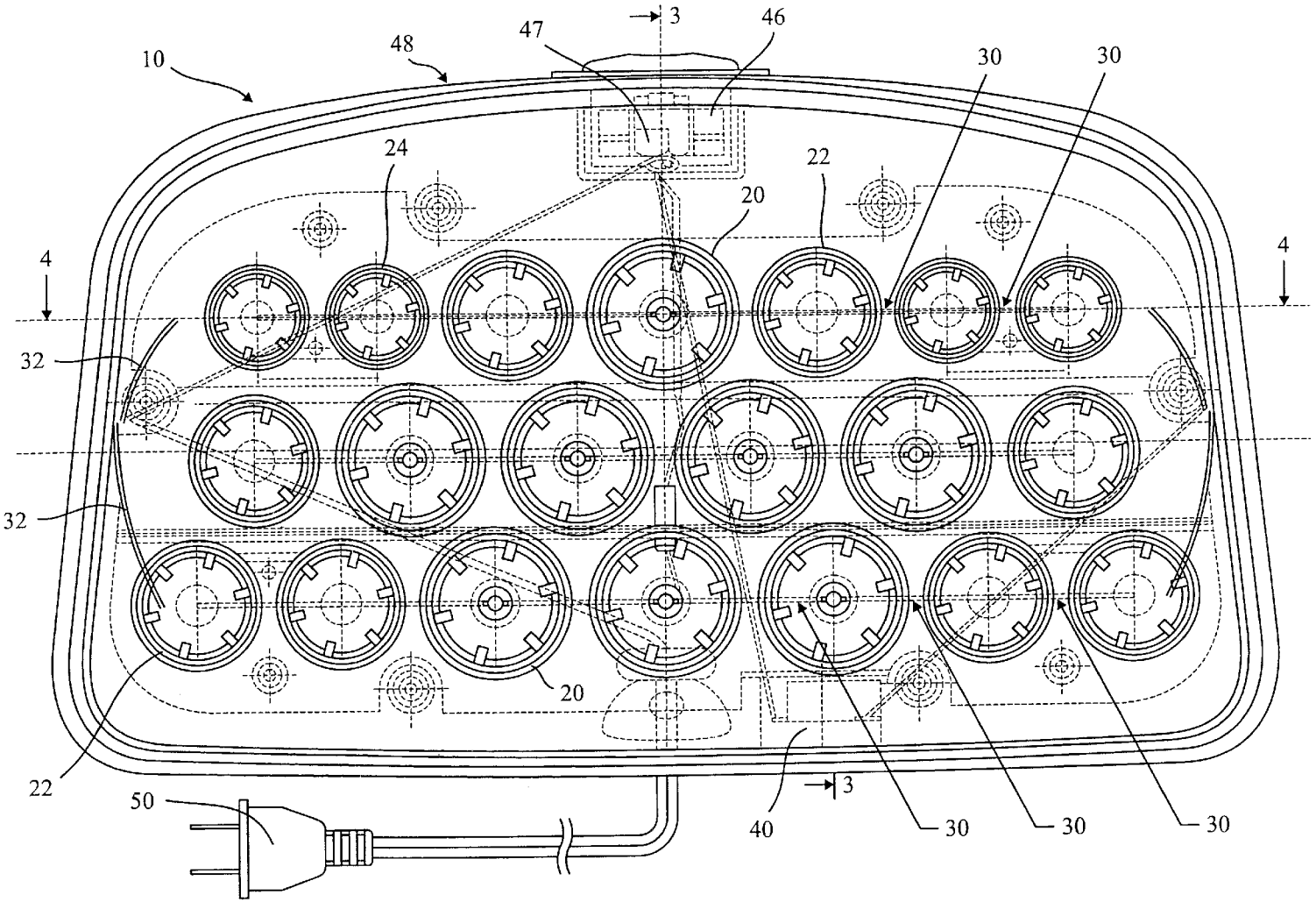
FIG. 1 is a side view partly in section and partly phantom of a hair curler heating appliance in accordance with the present invention.
Figure 2:
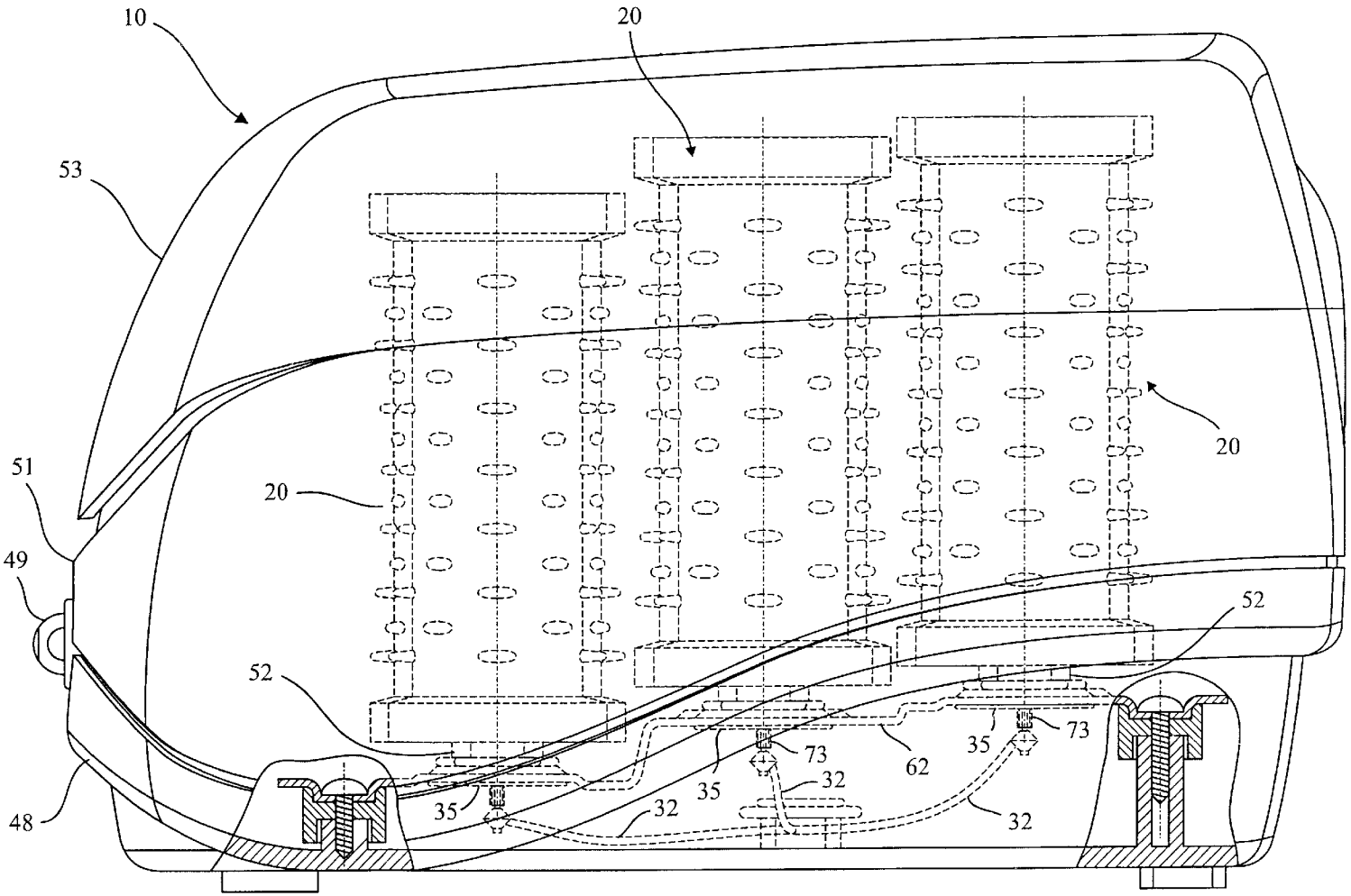
FIG. 2 is a top view partly in phantom of the hair curler heating appliance of FIG. 1.

Referring more particularly to FIGS. 1 through 5 wherein like numbers refer to similar parts, a hair curler heating appliance 10 embodying the present invention is provided with a case comprising lower housing 48, upper housing 51, and cover 53. Cover 53 is transparent in the illustrated preferred embodiment 10. Upper housing 51 includes a plurality of openings through which curlers 20, 22, 24 are inserted to engage heating posts 52 projecting from a base plate 62 mounted to the lower housing 48. Household alternating current is provided through a standard line cord 50 which feeds power to a three-position switch 46. A first switch position is off, a second switch position provides low power through rectifier 47 and a third switch position provides the full AC line signal to three rows of heaters 70 connected in parallel by wires 32. A fuse 45 is connected in line with the power cord to provide over-current protection. An indicator lamp 49 is lit when the switch 46 is positioned to apply power to the heaters 70 through the thermostat 60.

Figure 3:
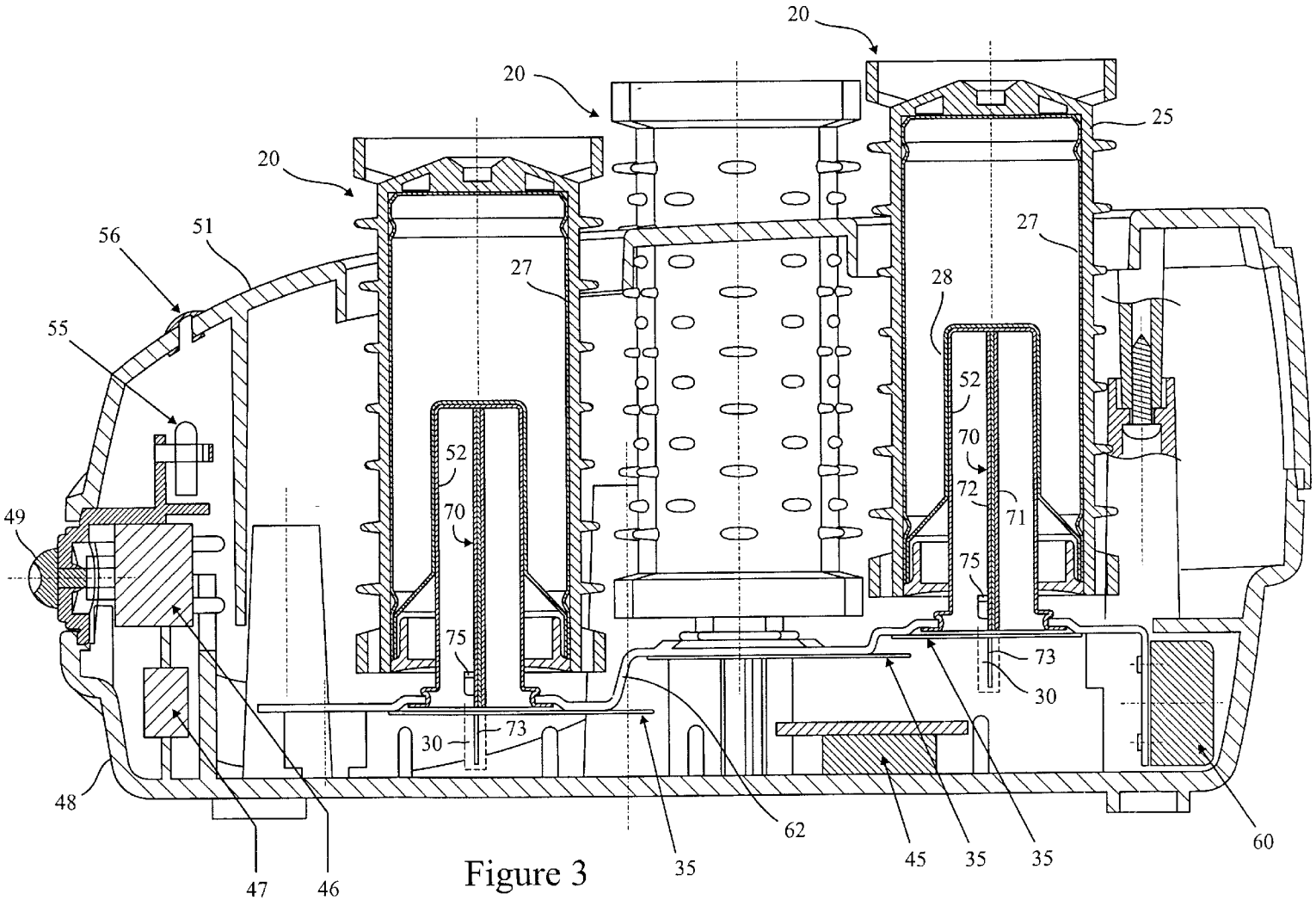
FIG. 3 is a side sectional view through the hair curler heating appliance of FIG. 2 along lines 3—3 thereof.
Figure 4:
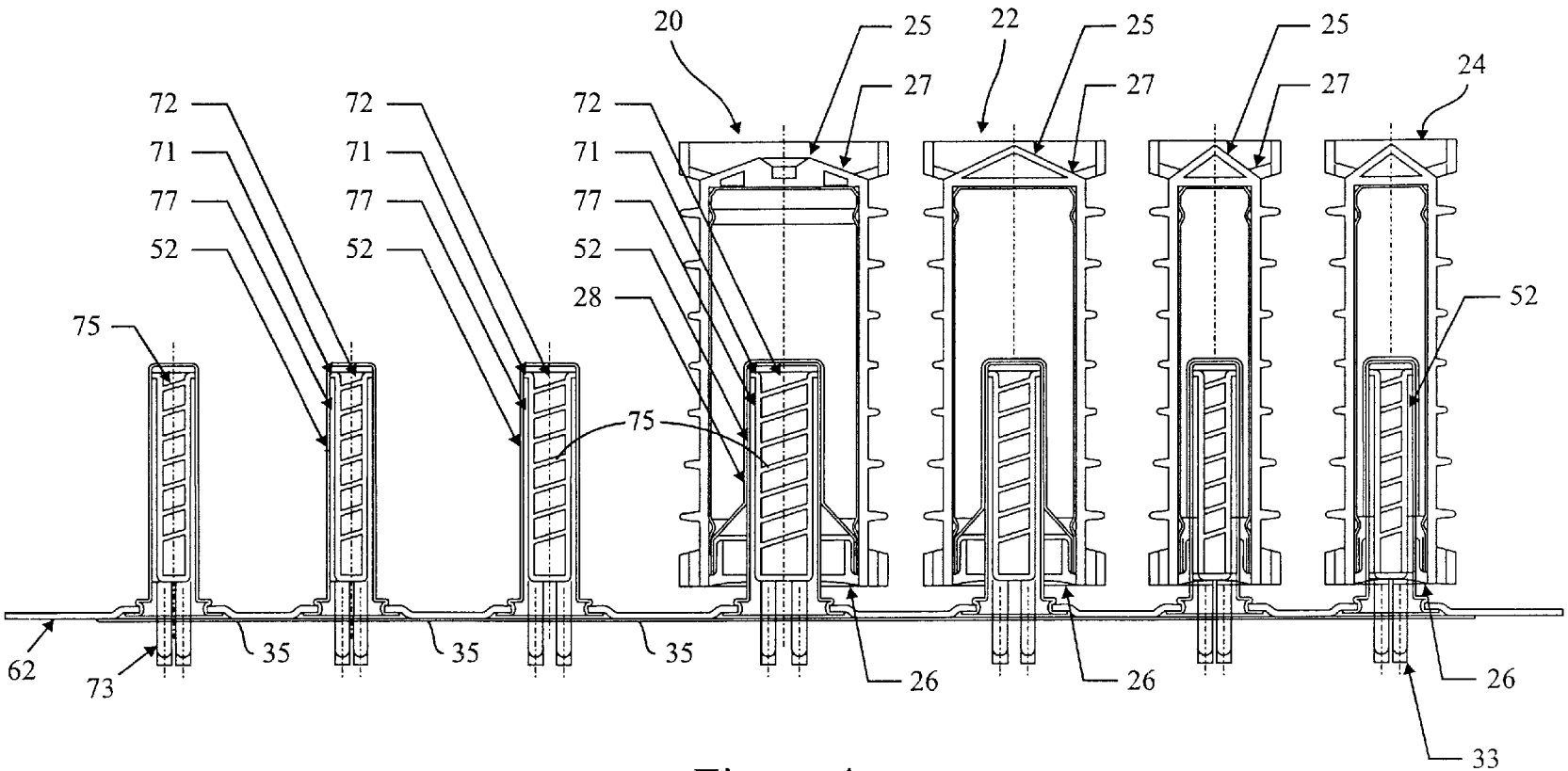
FIG. 4 is a side sectional view through the hair curler-heating appliance of FIG. 2 taken along line 4—4 thereof.

The illustrated embodiment accommodates three hair curlers having three diameters: large 20, medium 22, and small 24. Appropriately sized openings in upper housing 51 allow each size of curler to mate with an appropriately sized heating post 52 projecting upwardly from base plate 62. Base plate and heater tubes are constructed from aluminum, although other heat conductive metals would be appropriate. As can be seen in FIG. 3, heater tubes 52 are swage joined to base plate 62. Each heater tube surrounds a heater 70 vertically arranged within the tube 52.

Each heater comprises electrically insulating components made of rigid heat resistant "mica" material and a heater wire 75 wound around a portion of the mica insulating material. A support board 71 provides backing for the wire support 72 around which the heater wire 75 is wrapped. Together, support board 71, wire support 72, and heater wire 75 comprise a heater 70 that is vertically arranged within in each heater post 52. A mica plate 35 is arranged beneath each row of vertically projected heaters 70 to insulate the heating wire 75 and connections 73. Mica paper 77 is formed into a cylinder to electrically insulate each heater 70 from its respective heater post 52. Heat resistant electrical insulation 33 surrounds each terminal connection 73, 30.

Figure 5:
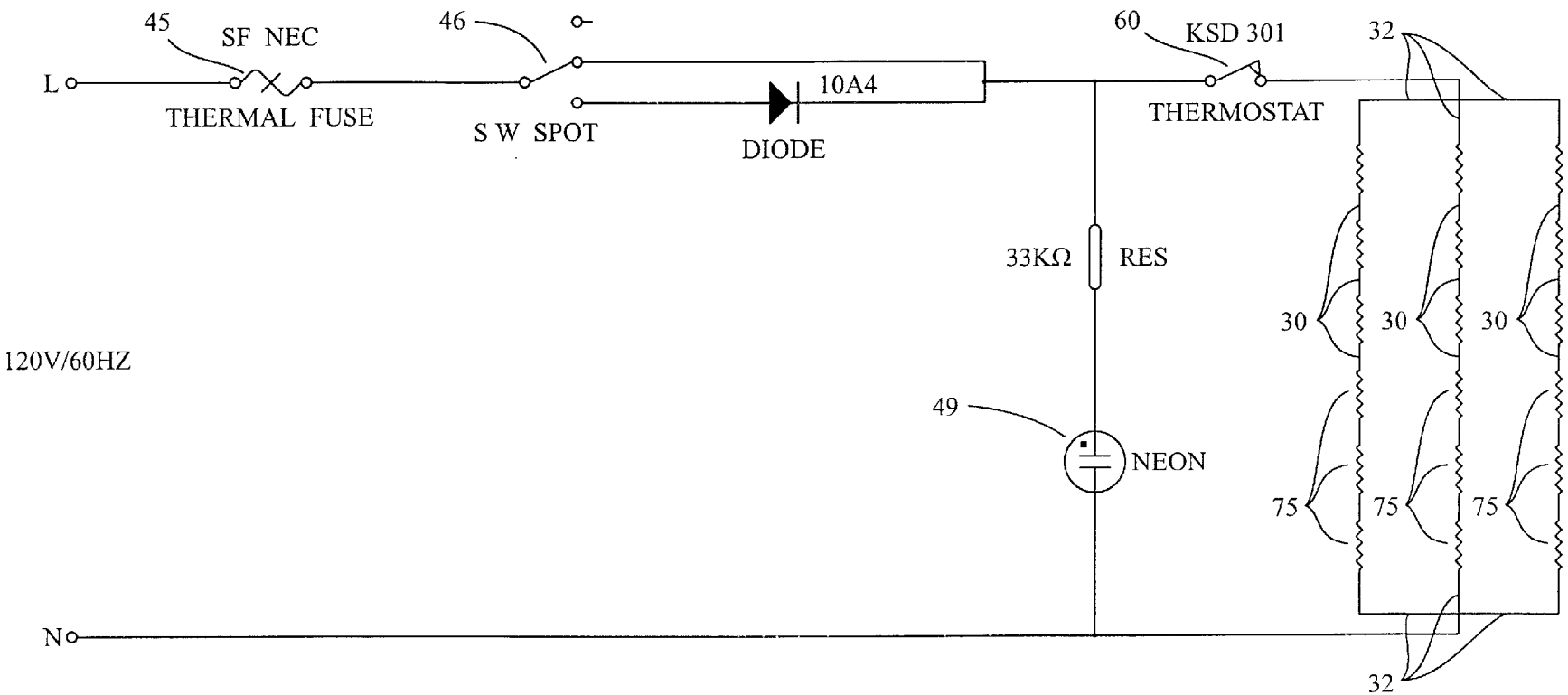
FIG. 5 is a schematic diagram of the hair curler heating appliance of FIGS. 1–4.

Connecting terminals 73 from each heater 70 project through the mica plate 35 and provide an electrical connection between the heater wire 75 and stainless steel wires 30 that connect each row of heaters 70 in series. The three series connected rows of heaters 70 are connected in parallel by wires 32 as best illustrated in FIG. 5. Thus, each curler 20, 22, 24 is disposed over a heater post 52 which contains its own individual heater 70. Each row of heaters 70 is interconnected and the rows of heaters are supplied with alternating current.

Each curler 20, 22, 24 comprises a plastic outer housing 25 and a metal inner housing comprising an outer tube 27 and an inner tube 28. Outer tube 27 is configured to be received in the plastic outer housing 25 and provide support thereto. Inner tube 28 is configured at its upper end to closely receive the heater tube 52 in a metal-to-metal interface to facilitate the exchange of heat from the heater tube 52 to the curler. A lower portion of the inner tube 28 is flared to facilitate engagement of each curler over its respective post 52. An end cap 26 defines a central opening on each curler through 20 which the heater post 52 penetrates.

This configuration places the source of heat (heater 70) axially in the middle of each roller 20, 22, 24. Heat generated by the heaters 70 must pass through the curler 20, 22, 24. This arrangement is extremely efficient in terms of heat transfer from the heater to the roller. Further, no part of the heater is arranged outside the heater post, so substantially all heat energy generated by the heater 70 is transferred first and primarily through the heater post 52. A thermostat 60 is connected to the base plate and calibrated to remove power from the heaters 70 when the base plate 62 reaches a predetermined temperature. The temperature of the base plate 62 will be relatively low when compared to the temperature inside each curler 20, 22, 24 because of the thermal relationships discussed above. Therefore, the temperature at which thermostat 60 will disconnect power is adjusted accordingly.

The baseplate 62 is formed into a three-tier configuration with each parallel row of heater posts 52 arranged side by side on a tier. Heater posts 52 are staggered from row to row producing an efficient arrangement of curlers in which the largest curlers 20 are arranged in the center of each row and surrounded by curlers of smaller diameter 22, 24. Each curler protrudes above upper housing 51 for easy retrieval. Cover 53 is hinged so it can be lowered during the curler heating process and raised for hair setting to further retain and conserve heat.

Each heater is surrounded by a cylinder of mica insulating paper 77 to ensure that the heater wire 75 does not contact the aluminum heater post. Further, the housing upper portion covers and surrounds the aluminum base plate and heater posts 52 in spaced relationship. Each curler in turn is entirely surrounded by plastic material 25, 26. Together, the electrical insulation, upper and lower housing, and plastic encased curlers 20, 22, 24 comprise a safe and convenient hair curler heating appliance 10. Energy efficiency is maximized by the fact that heat energy is generated only where it is needed, i.e., within each heater post 52 which are in turn surrounded by curlers 20, 22, 24. No portion of the heaters 70 are exposed to dissipate heat energy. Any heat energy conducted to the base plate 62 is used for the purposes of temperature regulation by thermostat 60.

While a preferred embodiment of the foregoing invention has been set forth for purposes of illustration, the foregoing description should not be deemed a limitation of the invention herein. Accordingly, various modifications, adaptations, and alternatives may occur to one skilled in the art without departing from the spirit and the scope of the present invention.

What is claimed is:

1. A hair curler heating appliance comprising:

a plurality of heating posts, each heating post comprising:

a vertically disposed generally cylindrical thermally conductive tube, said tube extending from a closed upper end to an open bottom end and having an axis; and a heater surrounded by said tube and disposed generally along said axis, said heater extending substantially from said closed end to said open end;

a thermally conductive base plate to which said conductive tubes are secured such that at least a portion of the heat generated by said heater is transferred to said base plate;

a thermostat arranged to sense the temperature of said base plate and disconnect power to said heaters when said base plate reaches a predetermined temperature; and a plurality of curlers, each said curler comprising a thermally conductive inner tube configured to closely receive one said heating post, wherein a mated heating post and hair curler inner tube define a heat transfer interface surrounding each said heater.

2. The hair curler heating appliance of claim 1, wherein said plurality of heating posts secured to a thermally conductive base plate in rows and said heaters comprise electrical resistance heaters.

3. The hair curler heating appliance of claim 2, wherein said heaters are arranged in at least one series such that alternating current passes through multiple said heaters.

4. A hair curler heating appliance comprising:

a plurality of hair curlers axially extending between first and second ends, each hair curler comprising an inner tube defining an axial cavity, said inner tube surrounded by a radially spaced outer tube, said axial cavity defining an opening at one end of said hair curler;

a plurality of axially extending metal heating posts, each said heating post configured to be received in said axial cavity in intimate contact with said inner tube, each said heating post surrounding an electrical resistance heater;

a thermally conductive base plate to which said plurality of axially extending metal heating posts are affixed such that heat generated by said heaters is conducted from said heating posts to said plate; and a thermostat arranged to sense a temperature of said base plate, said thermostat comprising power switching means for maintaining the temperature of said base plate within a pre-determined range, wherein each of said plurality of hair curlers has a complementary heating post and the intimate contact between said inner tube and said heating post defines a circumferential thermal transfer interface substantially surrounding each electrical resistance heater.

5. The hair curler heating appliance of claim 4, wherein said plurality of heating posts are arranged in three parallel rows, the heaters in each row are arranged in series and the three series rows of heaters are connected in parallel to a switched current protected source of alternating current.

6. The hair curler heating appliance of claim 4, wherein said inner and outer tube are constructed of metal and are mechanically and thermally connected to each other adjacent an opening to said axial cavity.

7. The hair curler heating appliance of claim 6, wherein each said curler comprises a plastic cover configured to surround said outer tube.

8. A hair curler heating appliance comprising:

a plurality of curlers, each said curler comprising a metallic inner portion and a plastic outer portion, said metallic inner portion defining an axial cavity and an opening at one end of said curler leading into said axial cavity; and a curler heater comprising:

a lower housing defining a mounting space;

an upper housing configured to mount to said lower housing to further define said mounting space;

a metal base plate mounted to said lower housing within said mounting space;

a plurality of metal heating posts fixed to said base plate in staggered parallel rows, said heating posts projecting generally perpendicular to said base plate and toward said upper housing;

a plurality of electrical resistance heaters, each said heater disposed within and substantially surrounded by a said heating post; and a thermostat arranged to sense a temperature of said base plate, said thermostat comprising means for connecting and disconnecting power to said electrical resistance heaters to maintain said temperature within a pre-defined range, wherein the axial cavity of each said hair curler is configured to receive at least one of said heating posts and a heating post is provided for each said hair curler and heat produced by said heaters is conducted from said heating posts to said base plate.

9. The hair curler heating appliance of claim 8, wherein said heating posts and base plate are aluminum.

10. The hair curler heating appliance of claim 8, wherein each said hair curler and a received heating post define a heat transfer interface surrounding each said heater.

11. The hair curler heating appliance of claim 8, wherein said upper housing defines a plurality of openings through which said plurality of hair curlers pass to receive said heating posts.

12. A hair curler heating appliance comprising:

a plurality of resistive heaters;

a plurality of heat conductive heater tubes;

a plurality of hair curlers, each said hair curler defining an axially extending interior cavity configured to receive one of said heater tubes;

a base plate, wherein each of said plurality of heater posts are joined to said base plate; and a thermostat arranged to sense a temperature of said base plate and disconnect an electrical energy supply to said plurality of resistive heaters when said base plate reaches a pre-determined temperature;

wherein each of said plurality of resistive heaters is substantially surrounded by one of said plurality of heater tubes and each of said plurality of hair curlers receives one of said heater tubes such that substantially all heat generated by each of said resistive heaters is transferred to one said hair curler through one said heater tube.

* * * * *